United States Patent [19]

Ohara et al.

[11] Patent Number: 5,071,824

[45] Date of Patent: Dec. 10, 1991

[54] HEAT TRANSFER SHEET, METHOD FOR PRODUCING IT, AND METHOD OF HEAT TRANSFER

[75] Inventors: Shuichi Ohara; Satoru Amou; Shinichi Akasaka, all of Hitachi, Japan

[73] Assignee: Hitachi, Ltd., Tokyo, Japan

[21] Appl. No.: 406,536

[22] Filed: Sep. 13, 1989

[30] Foreign Application Priority Data

Sep. 21, 1988 [JP] Japan ..... 63-235009

[51] Int. Cl.[5] ..... B41M 5/035; B41M 5/26

[52] U.S. Cl. ..... 503/227; 8/471; 427/146; 428/195; 428/913; 428/914

[58] Field of Search ..... 8/471; 428/195, 913, 428/914; 503/227

[56] References Cited

FOREIGN PATENT DOCUMENTS 0258856 3/1988 European Pat. Off. ..... 503/227

3111095 5/1988 Japan ..... 503/227

*Primary Examiner*—Bruce H. Hess

*Attorney, Agent, or Firm*—Antonelli, Terry, Stout & Kraus

[57] ABSTRACT

A heat transfer sheet which has a high recording sensitivity and can form image of high maximum reflection density and of high contrast is provided by containing in an ink layer of the heat transfer sheet at least one dye which has a product of an extinction coefficient ($l.cm^{-1}.g^{-1}$) and an evaporation or sublimation rate at 240° C. (wt $\%.min.^{-1}$) of at least $1.8\times10^2$ ($l.wt\ \%.cm^{-1}.g^{-1}.min^{-1}$).

4 Claims, 4 Drawing Sheets

HEAT TRANSFER SHEET, METHOD FOR PRODUCING IT, AND METHOD OF HEAT TRANSFER

BACKGROUND OF THE INVENTION

The present invention relates to a heat transfer sheet used in heat transfer printers, a method for producing the heat transfer sheet and heat transfer method and, in particular, to a heat transfer sheet high in recording sensitivity and high in maximum recording density, a method for producing the heat transfer sheet and a heat transfer method.

Recently, heat transfer printers have been widely used as printers for making hard copies of images formed on various displays.

As recording material used in the printers, a heat transfer sheet and a recording sheet are used.

This heat transfer sheet comprises a substrate and, provided thereon, an ink layer containing a dye which transfers onto a recording sheet by sublimation, evaporation or diffusion with application of heat. (This dye is hereinafter referred to as "sublimating dye".) Furthermore, this heat transfer sheet has the feature that transfer (recording) density (transfer quantity of dye and reflection density of print image) can be easily controlled by intensity of heat energy applied without deterioration of resolution.

Many examples of such heat transfer sheet are disclosed in Japanese Patent Kokai (Laid-Open) No. 60-101087 and others. As dyes used for this heat transfer sheet, disperse dyes which have been used in heat transfer printing are used. Japanese Patent Kokai (Laid-Open) No. 59-199295 and 60-27594 in addition to the above patent publication show examples of using such dyes.

Specific examples of these dyes are mentioned in Japanese Patent Kokai (Laid-Open) Nos. 61-148096, 61-163895 and 60-53564.

In the above conventional techniques, sufficient consideration has not been given to transfer of dye to a recording sheet, namely, density of image (reflection density) on the recording sheet at formation of image by transfer, i.e., recording sensitivity and maximum attainable recording (reflection) density.

As a result, as compared with heat-melt type heat transfer sheet in which an ink layer is molten or softened with heat and transfers to a recording sheet, the above-mentioned heat transfer sheet of sublimation type suffers from the problems that it requires much heat energy for transfer and long time for recording and contrast of resulting image is low.

SUMMARY OF THE INVENTION

The object of the present invention which aims at solving these problems is to provide a heat transfer sheet according to which an image of high recording density can be formed on a recording sheet with low energy, an image of high recording density can be formed on a recording sheet with a short recording time and an image of high contrast and high quality can be formed on a recording sheet, and a method for producing this heat transfer sheet and a heat transfer method.

The above object can be attained by providing on a substrate of heat transfer sheet an ink layer containing at least one dye which has a product of extinction coefficient ($l.cm^{-1}.g^{-1}$) and evaporation or sublimation rate (wt $\%.min.^{-1}$) at 240° C. of at least $1.8\times10^2$ (l.wt $\%.cm^{-1}.g^{-1}.min.^{-1}$), preferably at least $9.0\times10^2$ (l.wt $\%.cm^{-1}.g^{-1}.min.^{-1}$).

The extinction coefficient here is a value expressed by A/c.d ($l.cm^{-1}.g^{-1}$) when maximum value of absorbance in the visible light region (380–780 nm in wavelength) in visible light absorption spectrum of dye solution is indicated by A, concentration of the dye solution is indicated by c ($g.l^{-1}$) and thickness of dye solution cell is indicated by d (cm).

The evaporation or sublimation rate is a value expressed by 100.(a-b)/a/t (wt $\%.min.^{-1}$) when initial weight of dye (at 0 in time) at a given temperature is indicated by a (g) and weight of the dye after lapse of t (min.) at that temperature is indicated by b (g).

This heat transfer sheet can be efficiently produced by coating of a substrate with a solution containing at least one dye mentioned above, a binder and a solvent, then volatilizing the solvent and drying the coated substrate.

As the substrate, there may be used a plastic sheet of about 3–10 μm in thickness such as a polyethylene terephthalate (PET) sheet, a polyphenylene sulfide sheet, or the like.

The binder is preferably a high molecular compound having film-formability and includes, for example, polyester, polyamide, polycarbonate, polyvinyl butyral, and cellulose derivatives.

As the solvent, there may be used those which dissolve the binder and preferably also dissolves the dye and examples thereof which depend on the kinds of dye and binder used are various organic solvents such as tetrahydrofuran, acetone, toluene, methyl ethyl ketone, and methanol.

Furthermore, in formation of image on a recording sheet by a heat transfer printer using the heat transfer sheet containing at least one dye mentioned above, heat transfer image can be formed on a recording sheet with low energy or in a short time by carrying out the heat transfer by lowering the voltage applied to thermal head or shortening the maximum duration of applied voltage per 1 dot of record image depending on recording sensitivity when the heat transfer is carried out in the ink portion of high recording sensitivity containing the above dye than when the heat stransfer is carried out in the portion of low recording sensitivity.

If necessary, a heat resistant lubricating layer may be provided on the surface of the substrate on which no ink layer is formed in order to improve heat resistance or lubricating property of the substrate. Materials to be used for this layer include, for example, silicone resin, heat resistant resins containing lubricant such as epoxy resin, melamine resin, and cellulose derivatives.

Especially, in order to effectively attain the object of the present invention, heat transfer sheet can be produced using at least one dyes selected from those represented by the following formulas (I)–(VII).

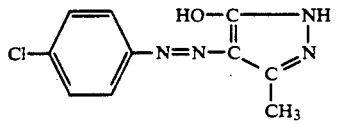

(I)

-continued (II)

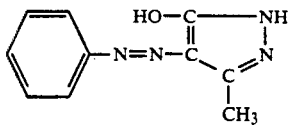

(III)

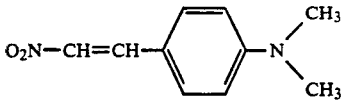

(IV)

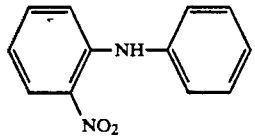

(V)

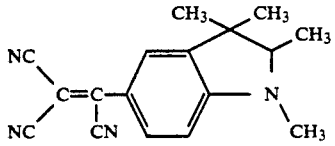

(VI)

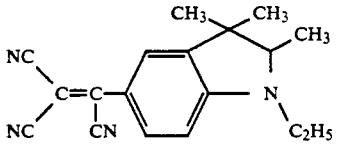

(VII)

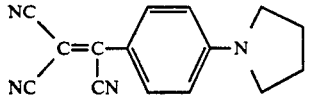

Reflection density of heat transfer image formed on a recording sheet when heat transfer is carried out with a given energy is nearly governed by transfer rate of dye from ink layer of heat transfer sheet to a recording sheet and reflection density per unit amount of dye and with increase of these values the reflection density increases.

DETAILED DESCRIPTION OF THE INVENTION

As a result of the inventors' intensive research on the properties of various dyes, it has been found that dye transfer rate under a certain energy has correlation with evaporation or sublimation rate of dye at a certain temperature and reflection density per unit amount of dye has correlation with extinction coefficient of dye. That is, it has been found that by using a dye large in the product of evaporation or sublimation rate and extinction coefficient in a heat transfer sheet, reflection density of the image formed on a recording sheet is enhanced and thus recording sensitivity is increased when heat transfer is carried out under a certain energy.

Figure 4:
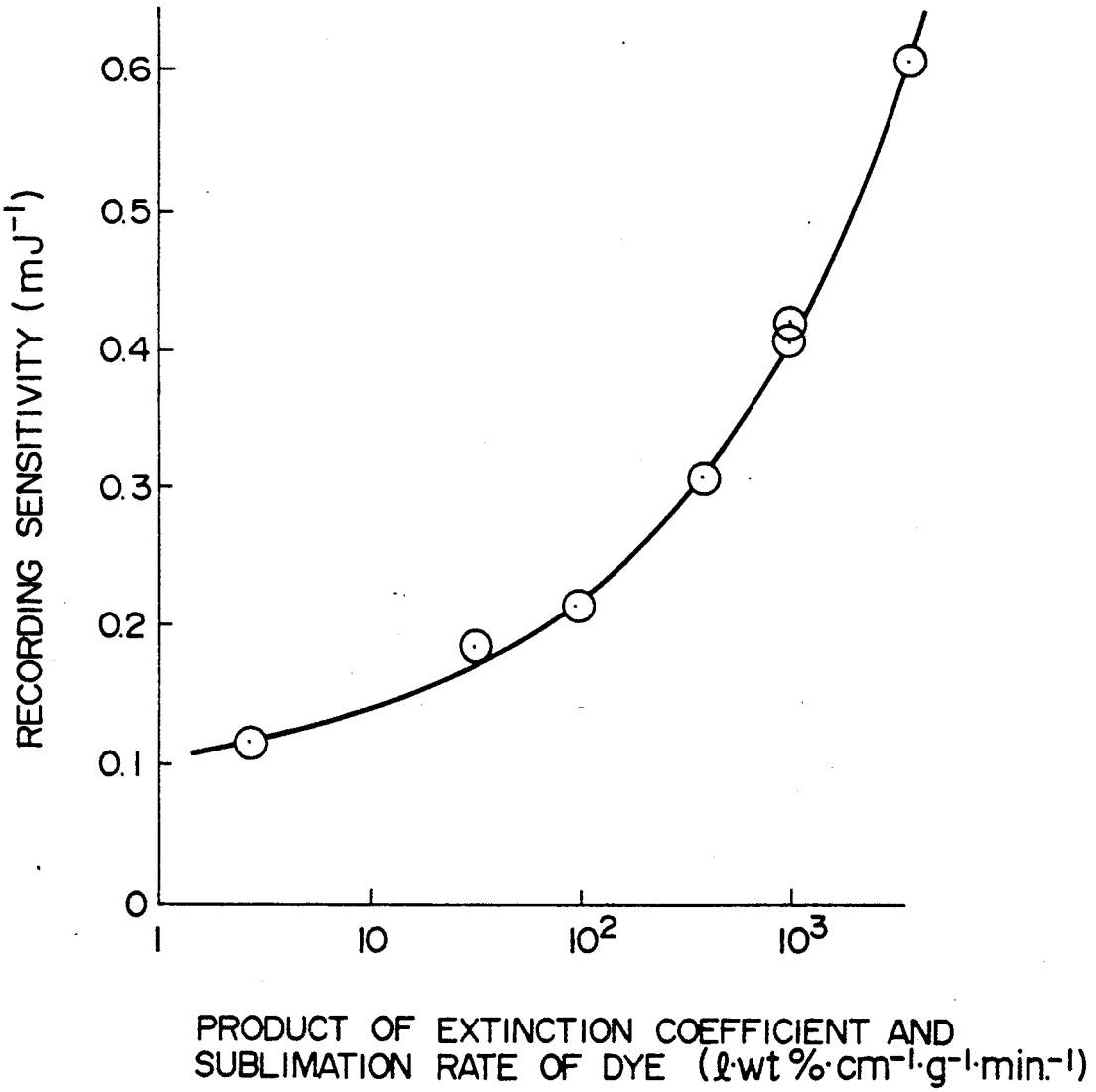
FIG. 4 is a graph which shows relation between recording sensitivity of heat transfer sheet which uses a yellow dye and product of extinction coefficient of the dye used and sublimation or evaporation rate of the dye used.
Figure 5:
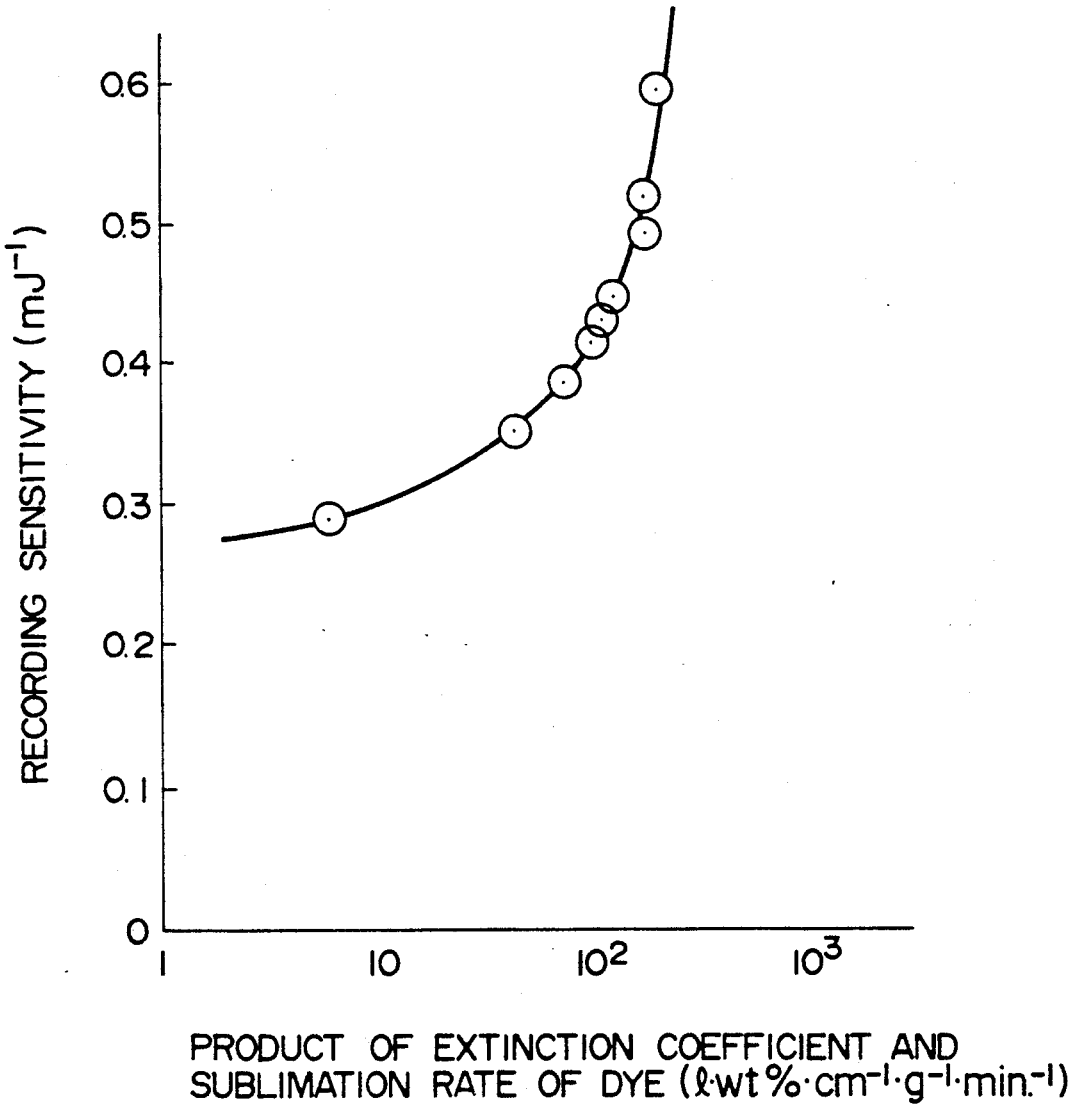
FIG. 5 is a graph which shows relation between recording sensitivity of heat transfer sheet which uses a magenta dye and product of extinction coefficient of the dye used and sublimation or evaporation rate.

This relation has been studied on yellow dyes as shown in Tables 1 and 2 given hereinafter and the results are shown in FIG. 4. Recording sensitivity on ordinate axis is a reciprocal of energy supplied to thermal head per one dot of image required for obtaining a reflection density of 1.0. Measurement of this relation was conducted according to the conditions used in Example 1 referred to hereinafter. Heat transfer printer used was such that energy supplied per 1 dot of image was 4.0 mJ when duration of applied voltage to thermal head was 15 ms. FIG. 5 shows the results of study on magenta dye.

As explained above, since with increase in reflection density of image formed on a recording sheet under a certain energy, maximum attainable reflection density naturally increases, range of transferable reflection density is enlarged and contrast of image formed on a recording sheet is enhanced, resulting in excellent image quality.

On the other hand, since a heat transfer sheet of high recording sensitivity can form image of high reflection density under a certain energy, in order to form an image of a certain reflection density, low energy may be supplied to heat transfer sheet. That is, voltage applied to thermal head of heat transfer printer may be decreased or duration of applied voltage to thermal head for formation of 1 dot of image may be shortened.

TABLE 1

| | Dyes | Extinction coefficient ($l.cm^{-1}.g^{-1}$) | Sublimation or evaporation rate at 240° C. ($wt\ \%.min.^{-1}$) | Product ($l.wt\ \%.cm^{-1}.g^{-1}.min.^{-1}$) |
|---|---|---|---|---|
| The present invention | Formula (I) | $7.7 \times 10$ | 5.0 | $3.9 \times 10^2$ |
| | Formula (II) | $7.5 \times 10$ | $1.3 \times 10$ | $9.8 \times 10^2$ |
| | Formula (III) | $1.5 \times 10^2$ | $2.3 \times 10$ | $3.5 \times 10^3$ |
| | Formula (IV) | $3.7 \times 10$ | $2.8 \times 10$ | $1.0 \times 10^3$ |
| | Formula (V) | $1.4 \times 10^2$ | 1.4 | $2.0 \times 10^2$ |
| | Formula (VI) | $1.6 \times 10^2$ | 1.2 | $1.9 \times 10^2$ |
| | Formula (VII) | $1.1 \times 10^2$ | 1.7 | $1.9 \times 10^2$ |
| Conventional methods | C.I. Disperse Yellow 16 | $8.7 \times 10$ | 1.1 | $9.6 \times 10$ |
| | C.I. Disperse Yellow 3 | $5.4 \times 10$ | $5.5 \times 10^{-1}$ | $3.0 \times 10$ |
| | C.I. Disperse | $4.2 \times 10$ | $6.5 \times 10^{-2}$ | 2.7 |

TABLE 1-continued

| Dyes | Extinction coefficient ($l.cm^{-1}.g^{-1}$) | Sublimation or evaporation rate at 240° C. (wt %.$min.^{-1}$) | Product ($l.wt\ \%.cm^{-1}.g^{-1}.min.^{-1}$) |
|---|---|---|---|
| Yellow 44 | | | |
| C.I. Disperse Violet 17 | $4.1 \times 10$ | 1.1 | $4.5 \times 10$ |
| C.I. Disperse Red 60 | $4.0 \times 10$ | $1.5 \times 10^{-1}$ | 6.0 |

Especially, extinction coefficient, sublimation or evaporation rate at 240° C. and the product of extinction coefficient and sublimation or evaporation rate of the dyes represented by the formulas (I)–(VII) are shown in Table 1. The product of extinction coefficient and sublimation or evaporation rate (hereinafter referred to as merely "product") is much greater than the product in the conventional dyes which are also shown in Table 1. Therefore, heat transfer sheets which use the dyes represented by the formula (I)–(VII) are high in recording sensitivity. The product of the dyes represented by the formulas (II)–(IV) is especially great and so heat transfer sheets which use these dyes are expecially higher in recording sensitivity.

The extinction coefficient of dye was measured by using isopropyl alcohol as a solvent and by using a quartz cell of 1 cm in light path length and a two wavelength spectrophotometer model 557 manufactured by Hitachi Limited as visible light absorption spectrum measuring apparatus. The sublimation or evaporation rate of dye at 240° C. was measured by using a differential thermal micro balance analyzer TGD-3000RHN or TA-1500 manufactured by Shinku Riko Co. "C.I." in Table 1 is the abbreviation for color index.

PREFERRED EMBODIMENTS OF THE INVENTION

EXAMPLE 1

Figure 1:
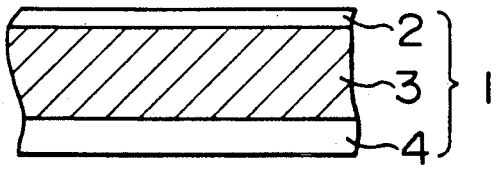
FIG. 1 is a schematic illustration in cross-section of a heat transfer sheet of one example according to the present invention.

Construction of a heat transfer sheet which is one embodiment of the present invention will be explained with reference to FIG. 1. FIG. 1 is a cross-sectional view of a heat transfer sheet wherein heat transfer sheet 1 comprises substrate 3 which is provided with heat resistant lubricating layer 2 on one side and ink layer 4 containing a sublimating dye and a binder on another side.

A mixture of 20 parts by weight of a 5 wt % solution of silicone (KS-722 manufactured by Shinetsu Kagaku Co.) in toluene and 1 part by weight of 0.5 wt % solution of a curing catalyst (PL-3 manufactured by Shinetsu Kagaku Co.) in hexane was coated on one side of a PET sheet (manufactured by Teijin, Limited) of 6 μm thick as substrate 3 and dried and then this coated sheet was left to stand for 5 minutes at 100° C. to cure the silicone, thereby to form heat resistant lubricating layer 2 of about 0.2 μm thick.

Then, 1 part by weight of the yellow dye represented by the formula (III) and 2 parts by weight of a polyester (BYLON 290 manufactured by Toyobo Co., Ltd.) were dispersed and dissolved in 27 parts by weight of tetrahydrofuran and this solution was applied to another side of the substrate 3 on which no heat resistant lubricating layer was present and dried to form ink layer 4 of about 1 μm thick, thereby to obtain a heat transfer sheet of this Example.

Recording sensitivity characteristics of this heat transfer sheet were measured using video printer VY-50 manufactured by Hitachi, LTD. as a heat transfer printer and a recording sheet in paper ink set VY-S100 for VY-50. For the measurement, VY-50 was partially modified so that voltage application control for thermal head can be externally carried out, namely, duration of applied voltage per line can be controlled from 0 to 15 ms at an interval of 1 ms. In this way, duration of applied voltage was changed every 1 ms from 0 to 15 ms and relation between reflection density of the resulting print images obtained on a recording sheet (the reflection density was measured by reflection densitometer DM-400 manufactured by Dainippon Screen Mfg. Co., Ltd.) and duration of applied voltage is shown in FIG. 2.

Figure 2:
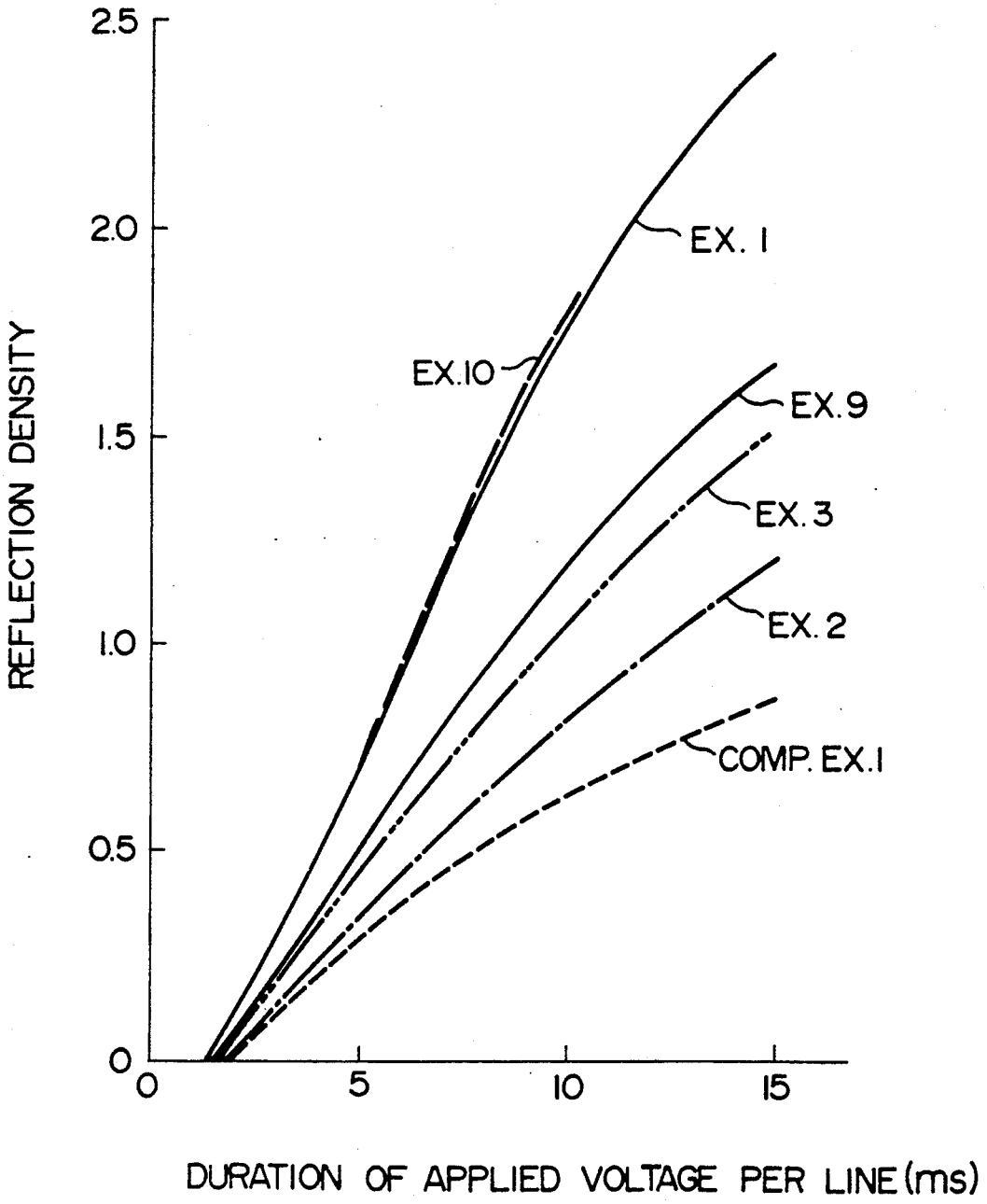
FIG. 2 is a graph which shows relation between duration of applied voltage and reflection density (recording sensitivity characteristics) per line of image formed in heat transfer sheet in Examples 1, 2, 3, 9, and 10 and Comparative Example 1.

The heat transfer sheet of this Example according to the present invention had very high reflection densities in all durations of applied voltage as compared with the characteristics of heat transfer sheet of the following Comparative Example 1 which used a conventional yellow dye (which are also shown in FIG. 2). That is, the heat transfer sheet of the present invention had high recording sensitivity.

Furthermore, printing was carried out on a recording sheet using the heat transfer sheet of this Example 1 by inputting image signal from television in this printer. As a result, a very clear yellow image of high contrast was obtained since the heat transfer sheet of this Example 1 can print an image of as high as 2.46 in reflection density as shown in FIG. 2. On the other hand, printing was carried out in the same manner using the heat transfer sheet of the following Comparative Example 1, but the resulting image was a yellow image of low contrast because this heat transfer sheet can provide a maximum reflection density of only 0.90 as shown in FIG. 2.

Therefore, a distinct full color image of high contrast can be printed on a recording sheet by combination of the heat transfer sheet for yellow color of this Example with a heat transfer sheet for magenta color of high recording sensitivity and a heat transfer sheet for cyan color of high recording sensitivity.

COMPARATIVE EXAMPLE 1

A heat transfer sheet was produced in the same manner as in Example 1 except that 1 part by weight of Disperse Yellow 16 (KAYASET YELLOW 937 manufactured by Nippon Kayaku Co., Ltd.) which is a conventional dye shown in Table 1 was used as a dye and printing was carried out in the same manner as in Example 1. The results are also shown in FIG. 2.

As compared with the results of Example 1, reflection density was low and recording sensitivity was low at any duration of applied voltage. This is because the product of extinction coefficient and sublimation or evaporation rate at 240° C. of the dye used here was very small.

EXAMPLE 2

A heat transfer sheet was produced in the same manner as in Example 1 except that 1 part by weight of the yellow dye represented by the formula (I) mentioned hereinbefore was used as the dye. Recording sensitivity characteristics of this heat transfer sheet were measured in the same manner as in Example 1. The results are also shown in FIG. 2.

The resulting recording sensitivity was lower than in Example 1 since the product of extinction coefficient and sublimation or evaporation rate at 240° C. of the dye used was smaller than that of the dye in Example 1 (refer to Table 1), but higher than in Comparative Example 1 since the product was larger than that of the dye in Comparative Example 1.

Therefore, a distinct image of high contrast can be printed on a recording sheet.

EXAMPLE 3

A heat transfer sheet was produced in the same manner as in Example 1 except that 1.5 part by weight of the dye used in Example 2 was used as the dye and 1.5 part by weight of the binder used in Example 1 was used as the binder. Recording sensitivity of this heat transfer sheet was measured in the same manner as in Example 1. The results are also shown in FIG. 2.

The resulting recording sensitivity was higher than in Example 2 since dye content in the ink layer was high although the same dye as used in Example 2 was used and a distict image of high contrast was obtained.

EXAMPLES 4 AND 5 AND COMPARATIVE EXAMPLE 2

Heat transfer sheets of Examples 4 and 5 and Comparative Example 2 were produced in the same manner as in Example 1 except that 1 part by weight of yellow dye represented by the formula (II) mentioned hereinbefore (Example 4), 1 part by weight of yellow dye represented by the formula (IV) mentioned hereinbefore (Example 5) and 1 part by weight of Disperse Yellow 3 (RULAFIX YELLOW 142 manufactured by BASF) (Comparative Example 2) were respectively used as dye. Recording sensitivity of these heat transfer sheets was measured in the same manner as in Example 1 and refelection densities of the images at 5, 10, and 15 ms in duration of applied voltage per line are shown in Table 2. Results of Examples 1 and 2 and Comparative Example 2 are also shown in Table 2 and these results are all those obtained under the same conditions except that dyes were different. As compared with the products in Table 1, the heat transfer sheet using dyes of larger product had higher recording sensitivity. The products of the dyes used in Examples 4 and 5 were greater than those of the dyes used in Comparative Examples 1 and 2 and the heat transfer sheets of Examples 4 and 5 had high recording sensitivity and gave distinct images of high contrast on a recording sheet.

TABLE 2

| Heat transfer sheet | Dyes used | Reflection density 5 ms | 10 ms | 15 ms |
|---|---|---|---|---|
| Example 1 | Formula (III) | 0.67 | 1.74 | 2.46 |
| Example 2 | Formula (I) | 0.35 | 0.82 | 1.21 |
| Example 4 | Formula (II) | 0.47 | 1.09 | 1.59 |
| Example 5 | Formula (IV) | 0.48 | 1.12 | 1.64 |
| Comparative Example 1 | Disperse Yellow 16 | 0.28 | 0.65 | 0.90 |
| Comparative Example 2 | Disperse Yellow 3 | 0.24 | 0.55 | 0.79 |

TABLE 2-continued

| Heat transfer sheet | Dyes used | Reflection density 5 ms | 10 ms | 15 ms |
|---|---|---|---|---|
| Example 2 | 3 | | | |

EXAMPLE 6

A heat transfer sheet was prepared in the same manner as in Example 1 except that 1 part by weight of the magenta dye represented by the formula (V) was used and recording sensitivity was measured as in Example 1. The results are shown in FIG. 3.

Figure 3:
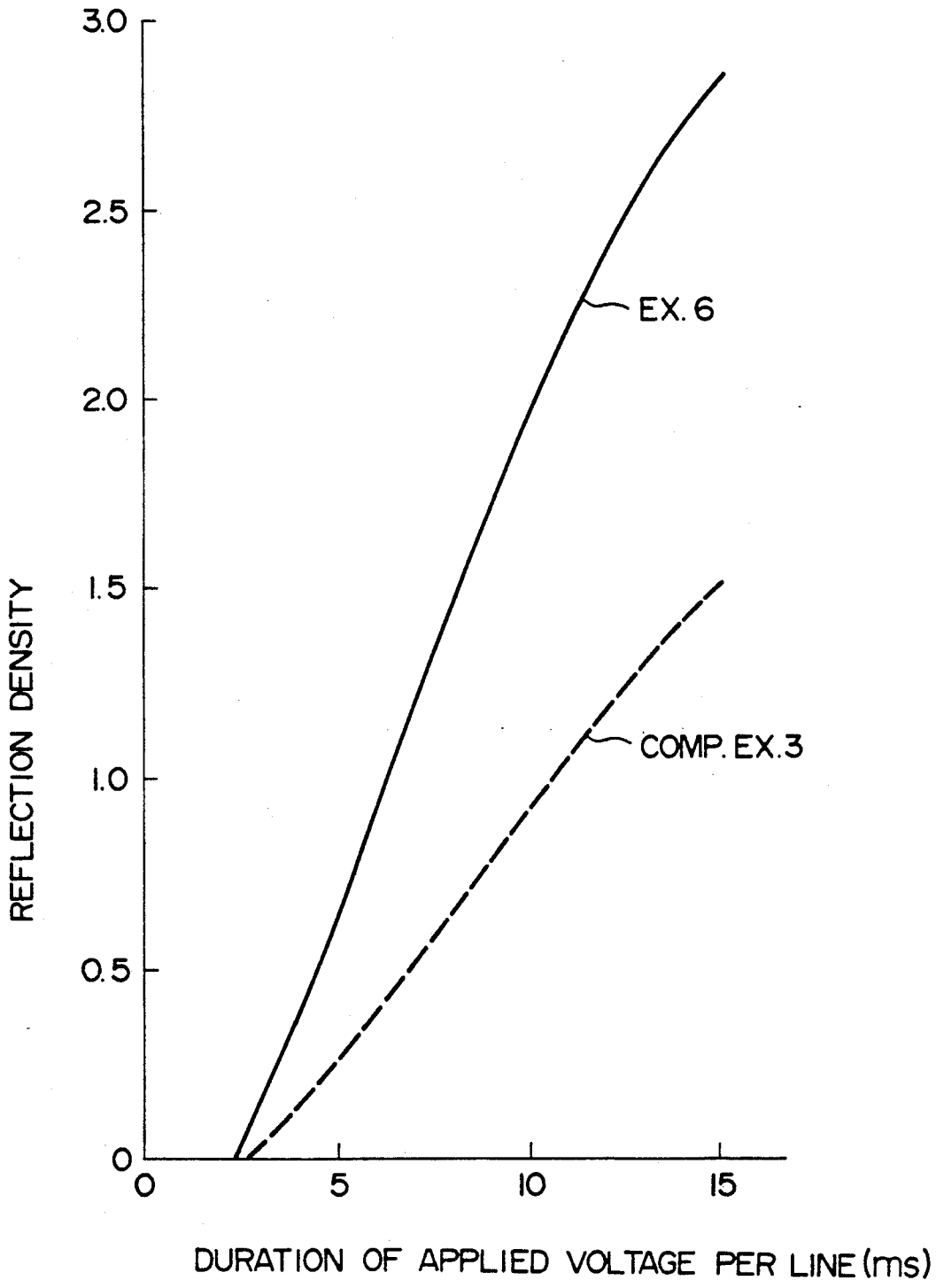
FIG. 3 is a graph which shows the same relation as in FIG. 2 on Example 6 and Comparative Example 3.

Very high reflection densities were obtained in this heat transfer sheet at all durations of applied voltage and recording sensitivity was high as compared with the properties of the heat transfer sheet of the following Comparative Example 3 which used conventional magnetic dye (the results are also shown in FIG. 3.). (This Example 6 deals with heat transfer sheets of magenta color and so it is meaningless to compare the results with those of Examples 1-5 and Comparative Examples 1 and 2 which relate to heat transfer sheets of yellow color.)

In the same manner as in Example 1, image from television were printed to obtain distinct magenta image of high contrast on a recording sheet because the heat transfer sheet of this Example 6 was high in recording sensitivity and attainable maximum reflection density was high as compared with the heat transfer sheet of Comparative Example 3. Therefore, distinct full color image of high contrast can be obtained on recording sheet by using in combination the heat transfer sheet of this Example, the heat transfer sheet for yellow color of Examples 1-5 and a heat transfer sheet of high recording sensitivity for cyan color.

COMPARATIVE EXAMPLE 3

A heat transfer sheet was prepared in the same manner as in Example 1 except that 1 parts by weight of Disperse Violet 17 (KAYASET RED 130 manufactured by Nippon Kayaku Co., Ltd.) which was a conventional magenta dye shown in Table 1 was used as a dye and recording sensitivity was measured as in Example 1. The result is also shown in FIG. 3.

Since the product of extinction coefficient and sublimation or evaporation rate at 240° C. of the dye used was smaller than that of the dye used in Example 6, reflection density was low and recording density was inferior.

EXAMPLES 7 AND 8 AND COMPARATIVE EXAMPLE 4

Heat transfer sheets of Examples 7 and 8 and Comparative Example 4 were produced in the same manner as in Example 1 except that 1 parts by weight of magenta dye represented by the formula (VI) mentioned hereinbefore (Example 7), 1 part by weight of magenta dye represented by the formula (VII) mentioned hereinbefore (Example 8) and 1 part by weight of Disperse Red 60 (RULAFIX RED 430 manufactured by BASF) (Comparative Example 4) were respectively used as dye. Recording sensitivity of these heat transfer sheet was measured in the same manner as in Example 1 and reflection densities of the images at 5, 10, and 15 ms of duration of applied voltage per line are shown in Table 3. Results of Example 6 and Comparative Example 3 are also shown in Table 3. These results are all those obtained under the same conditions except that dyes were different. When compared with the products in Table 1 in the same manner as in the example where the yellow dye of Table 2 was used, the heat transfer sheet which used dyes of larger product had higher recording sensitivity. The products of the dyes used in Examples 7 and 8 were greater than those of the dyes used in Comparative Examples 3 and 4 and the heat transfer sheets of Examples 7 and 8 had high recording sensitivity and gave distinct images of high contrast on a recording sheet.

TABLE 3

| Heat transfer sheet | Dyes used | Reflection density 5 ms | 10 ms | 15 ms |
|---|---|---|---|---|
| Example 6 | Formula (V) | 0.63 | 1.97 | 2.85 |
| Example 7 | Formula (VI) | 0.51 | 1.59 | 2.49 |
| Example 8 | Formula (VII) | 0.46 | 1.49 | 2.40 |
| Comparative Example 3 | Disperse Violet 17 | 0.24 | 0.92 | 1.52 |
| Comparative Example 4 | Disperse Red 60 | 0.20 | 0.70 | 1.19 |

EXAMPLE 9

A heat transfer sheet was prepared in the same manner as in Example 1 except that the heat resistant lubricating layer was not provided on the substrate. Relation between duration of applied voltage and reflection density of image was measured using the resulting heat transfer sheet and the printer used in Example 1 in the same manner as in Example 1 except that voltage applied to thermal head was reduced to 10 V (energy per 1 dot at duration of 15 ms was about 2.78 mJ) (the applied voltage in Example 1 was 12 V and energy was 4.0 mJ). The results are also shown in FIG. 2. Although voltage applied to thermal head was reduced, reflection densities were very high at all durations of applied voltage as compared with those in Comparative Example 1. Furthermore, since the voltage applied to thermal head was reduced and thus heat released from thermal head decreased, no troubles such as sticking occurred in travelling of the heat transfer sheet even if a heat resistant lubricating layer was not provided.

As shown above, since the heat transfer sheet of this Example 9 (or Example 1) is very high in recording sensitivity, distinct image with sufficiently high reflection density can be obtained on a recording sheet even if voltage applied to thermal head is reduced. In other words, according to this Example, not only distinct image can be obtained as compared with comparative examples, but also electric power consumed by thermal head can be reduced (about ⅔ of the power in Example 1 or Comparative Example 1) by reduction of voltage applied to thermal head and as a result electric power consumed by the whole printer can be reduced.

EXAMPLE 10

Relation between duration of applied voltage and reflection density was measured in the same manner as in Example 1 except that heat transfer sheet produced in Example 9 was used and the maximum duration of applied voltage per line of print was shortened to 10 ms (maximum energy supplied per 1 dot of image of this time was about 2.67 mJ) (4.0 mJ with 15 ms until Example 9) and besides leaving time (during which no voltage is applied) of thermal head after application of voltage was also shortened to ⅔. The results are also shown in FIG. 2. Recording sensitivity for a duration of applied voltage until 10 ms was somewhat higher than in Example 1 and maximum reflection density was lower than in Example 1 because maximum duration of applied voltage was short. However, as compared with Comparative Example 1, the maximum reflection density was far higher in spite of the fact that the maximum duration of applied voltage was shortened to ⅔. Furthermore, when image from television was printed under the above conditions, time required for recording of image on recording sheet was shortened by 6 seconds than in Example 1 (about 17 seconds was required in Example 1) owing to the short maximum duration of applied voltage per line and thus recording sensitivity was improved. In addition, the image obtained was more distinct and higher in contrast than the image recording using the heat transfer sheet of Comparative Example 1 and under the condition of application of voltage used in Example 1. When image was recorded using the heat transfer sheet of Comparative Example 1 and under the conditions for application of voltage in this Example 10, the maximum reflection density was further decreased to 0.65 and only image of very low contrast was obtained.

Moreover, since maximum duration of applied voltage per line was short in this Example, the maximum exothermic energy per line of thermal head was small and thus electric power consumed by printer can be reduced.

As mentioned above, since heat transfer sheet of high recording sensitivity is used in this Example, even if maximum duration of applied voltage per line of image is shortened, there can be obtained reflection density sufficiently higher than when heat transfer sheet of comparative example is used and the maximum duration of applied voltage is not shortened. In other words, not only image is obtained which is more distinct than that of comparative example, but also recording time and electric power consumed can be reduced.

According to the present invention, recording sensitivity can be improved and distinct and high contrast images having high maximum reflection density can be recorded by using a dye having a large value in the product of extinction coefficient and sublimation or evaporation rate.

Furthermore, owing to the high recording sensitivity of heat transfer sheet, sufficiently distinct image can be recorded even when recording energy is reduced. That is, electric power consumed by heat transfer printer, recording time and total electric power consumed can be reduced.

What is claimed is:

1. A heat transfer sheet which comprises a substrate and, provided on one side thereof, an ink layer containing binder having film-formability and a dye capable of transferring onto a recording sheet upon application of heat, said dye comprising at least one dye which has a product of an extinction coefficient ($l.cm^{-1}.g^{-1}$) and an evaporation or sublimation rate at 240° C. (wt %. $min.^{-1}$) of at least $9.0\times10^2$ ($l.wt\ \%.cm^{-1}.g^{-1}.min.^{-1}$).

2. A method for producing a heat transfer sheet which comprises a substrate and, provided on one side thereof, an ink layer containing a dye capable of transferring onto a recording sheet upon application of heat which comprises coating on one side of a substrate a solution containing at least one dye having a product of an extinction coefficient ($l.cm^{-1}.g^{-1}$) and an evaporation or sublimation rate (wt $\%.min.^{-1}$) at 240° C. of at least $9.0\times10^2$ (l.wt %.cm$^{-1}$.g$^{-1}$.min.$^{-1}$), a binder having film-formability and a solvent and drying the coat to form an ink layer containing the dye on the substrate.

3. A method for heat transfer by heat transfer printer using a heat transfer sheet comprising a substrate and, provided on one side thereof, an ink layer containing binder having film-formability and a dye capable of transferring onto a recording sheet upon application of heat by sliding with a thermal head, the heat transfer being carried out using the heat transfer sheet containing in the ink layer at least one dye having a product of the extinction coefficient (l.cm$^{-1}$.g$^{-1}$) and an evaporation or sublimation rate (wt %.min.$^{-1}$) at 240° C. that is at least $9.0\times10^2$ (l.wt %.cm$^{-1}$.g$^{-1}$. min.$^{-1}$) and by supplying an energy of 2.8 mJ or less per 1 dot of image to the thermal head of the heat transfer printer.

4. A heat transfer sheet which comprises a substrate and, provided on side thereof, an ink layer containing a binder having film-formability and a dye capable of transferring onto a recording sheet upon application of heat, said dye comprising at least one dye selected from the group consisting of the dyes represented by the following formulae (II-IV):

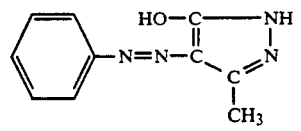

(II)

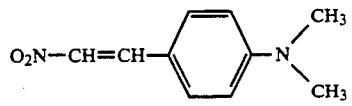

(III)

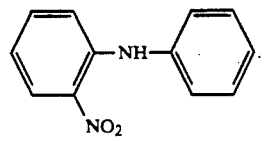

(IV)

* * * * *